US005765716A

United States Patent [19]

Cai et al.

[11] Patent Number: 5,765,716

[45] Date of Patent: Jun. 16, 1998

[54] CUP PROTECTOR

[75] Inventors: Liming Cai, West Chester; Michael G. Bodary, Downington, both of Pa.

[73] Assignee: Dopaco, Inc., Exton, Pa.

[21] Appl. No.: 758,156

[22] Filed: Nov. 25, 1996

[51] Int. Cl.[6] ..... B65D 25/20

[52] U.S. Cl. ..... 220/740; 220/739; 220/738; 220/903; 220/375

[58] Field of Search ..... 220/375, 412, 220/740, 737, 903, 739, 738; 215/306, 253, 258

[56] References Cited

U.S. PATENT DOCUMENTS

| | | | |
|---|---|---|---|
| Re. 25,618 | 7/1964 | Goodman . | |
| 697,496 | 4/1902 | Klotz | 220/412 |
| 2,617,549 | 11/1952 | Egger . | |
| 3,437,253 | 4/1969 | Davis et al. . | |
| 3,908,523 | 9/1975 | Shikaya . | |
| 4,054,221 | 10/1977 | Glover . | |
| 4,194,627 | 3/1980 | Christensen | 220/412 |
| 4,345,704 | 8/1982 | Boughton . | |
| 4,377,248 | 3/1983 | Stull | 215/306 |
| 4,872,577 | 10/1989 | Smith . | |
| 5,186,350 | 2/1993 | McBride | 220/740 |
| 5,205,473 | 4/1993 | Coffin, Sr. . | |
| 5,261,554 | 11/1993 | Forbes | 220/740 |
| 5,425,497 | 6/1995 | Sorensen . | |
| 5,474,199 | 12/1995 | Julius et al. . | |

*Primary Examiner*—Stephen J. Castellano

*Attorney, Agent, or Firm*—Dennison, Meserole, Pollack & Scheiner

[57] ABSTRACT

The cup protector includes a vertically elongate insulating sleeve slidably receiving a cup therein, the protector also including a closure lid integrally formed with the sleeve and selectively movable relative thereto.

7 Claims, 1 Drawing Sheet

FIG. 1
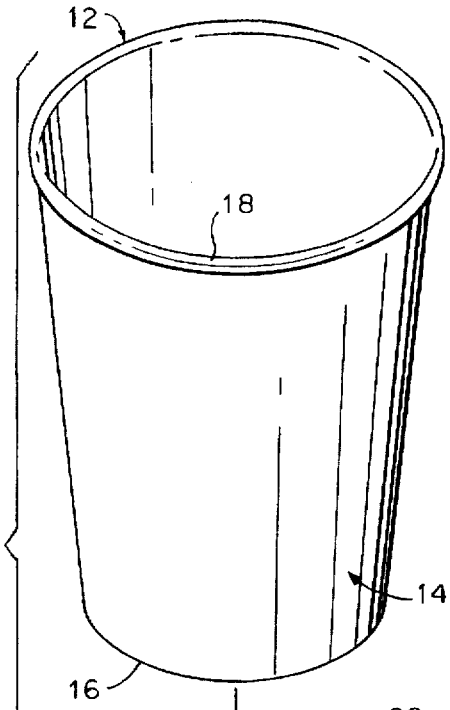
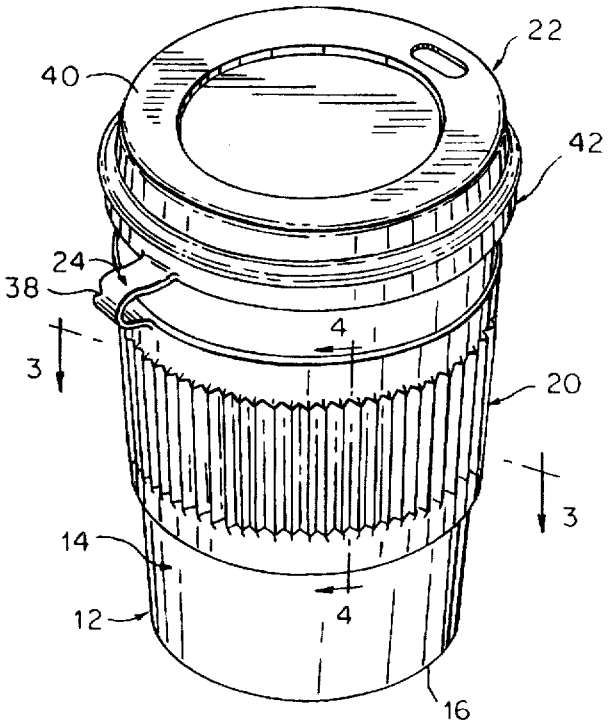
FIG. 2
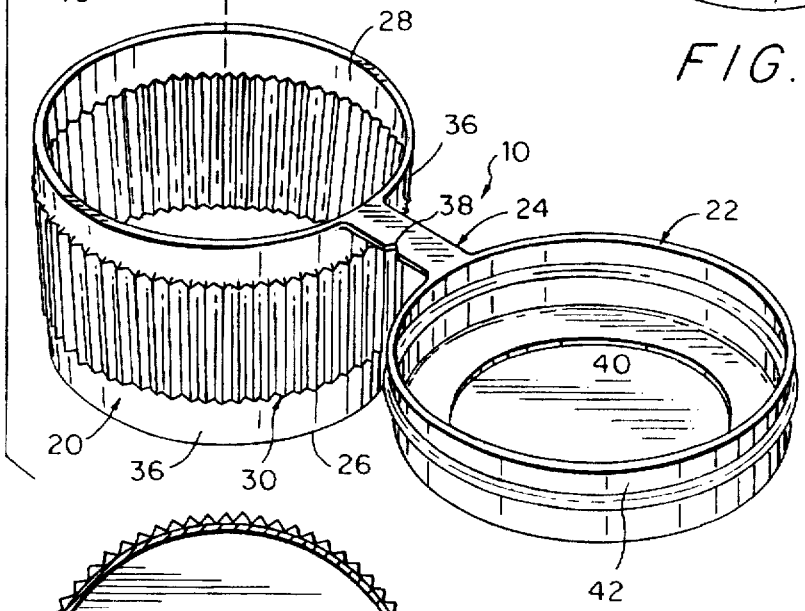
FIG. 4
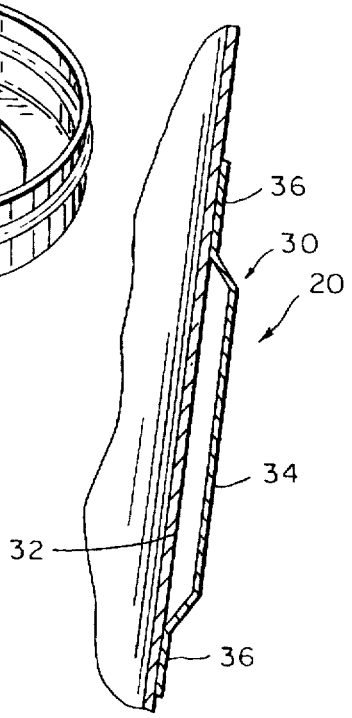
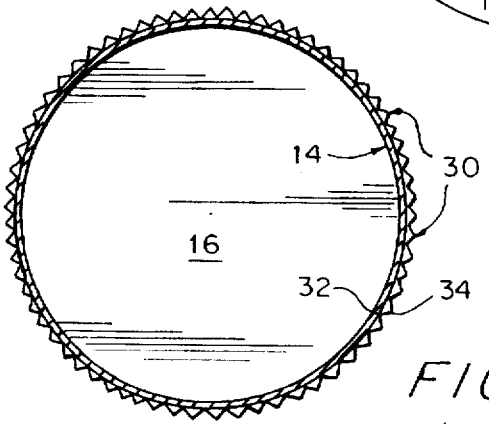
FIG. 3

CUP PROTECTOR

BACKGROUND OF THE INVENTION:

The use of disposable paperboard or plastic drink cups are universally known and used, with such cups accommodating both cold and hot beverages.

The basic cup configuration is that of an inverted truncated cone tapering upward from a circular base to an enlarged circular mouth normally defined by an outwardly rolled rim. When used for cold drinks, a cup with a thin body wall will normally suffice in that, other than for moisture or condensation on the outer surface of the cup and a coolness to the touch, the cup can be hand-held without significant discomforture.

However, with hot beverages the hand must be protected. This is normally achieved by using a more expensive thick-walled cup or a similarly expensive cup with separate fold out handles which by their very nature do not provide a very stable means to lift the filled and hot cup.

In the use of the conventional cups, it is also commonly known to provide removable snap-on lids to preserve and protect the contents of the cup.

SUMMARY OF THE INVENTION:

The present invention comprises a multiple function protector for a cup which allows for use of a conventional inexpensive cold drink cup as a container for all beverages both cold and hot.

The protector, much in the manner of a conventional cup lid, will be applied to or mounted on the cup, preferably immediately after a filling of the cup. Once mounted, the protector will provide a wide cup-encircling sleeve defining a hand-grip, and, unitary with the sleeve, a lid which closes the cup and protects the contents thereof. The lid, within the range of the integral joinder with the insulating sleeve, can be moved to fully open the cup for a convenient drinking therefrom. Further, should it be desirable, the lid can be severed from the sleeve for separate use or disposal.

The sleeve, tapered upwardly from an open lower end to a relatively wider open upper end, defines a vertical passage within which the cup is received, the taper of the sleeve conforming to the taper of cup for snug engagement thereabout as the sleeve is moved upward relative to the cup. The insulation effect, provided to protect the hand of the user of the cup, is formed by a series of spaces defined between the outer surface of the cup and the inner surface of the sleeve. This is done preferably by forming the sleeve, for at least a major portion of the height thereof sufficient as to define a hand-grip area, with vertical flutes, basically a corrugated effect peripherally about the sleeve which provides spaced ridges engaging the cup with alternating outwardly directed ridges defining the hand-grip surface and the insulating grooves immediately inward thereof.

The lid portion of the protector includes a top panel with an appropriate gripping flange thereabout which snap-locks to the cup rim. The integral joinder between the lid and sleeve comprises a tether in the nature of a flexible member which, within the length of the tether, allows the lid to freely pivot between open and closed positions. The tether includes an area of weakness facilitating a severing of the tether at a predetermined point for complete removal of the lid or sleeve, should such be desired.

While the protector is principally intended for use with a cup containing hot liquids, providing a cool hand-grip for the user, with cold drinks it will also provide a significant function in protecting the hand of the user from surface condensation on the cup as frequently occurs with iced drinks. It will also of course insulate against any excessive chilling of the hand.

BRIEF DESCRIPTION OF THE DRAWINGS:

FIG. 1 is a perspective view of the protector with a drinking cup exploded thereabove;

FIG. 2 is a perspective view of the protector mounted to a cup;

FIG. 3 is a transverse cross-sectional view taken substantially on a plane passing along line 3—3 in FIG. 2; and FIG. 4 is a vertical cross-sectional view taken substantially on a plane passing along line 4—4 in FIG. 2.

DESCRIPTION OF PREFERRED EMBODIMENTS:

Referring now more specifically to the drawings, the protector 10 has been illustrated in association with a conventional drink cup 12 having a generally inverted conical wall 14 tapering upwardly from a circular closed bottom and 16 to a rolled rim 18 defining a relatively larger open upper end.

The protector 10 includes a wide or vertically elongate sleeve 20 and a cup lid 22 integrally joined by a flat tether 24 of sufficient strength and flexibility as to accommodate repeated bending as the lid 22 is moved relative to the sleeve 20. The entire assembly is preferably formed of an appropriate food-compatible thermoformed polystyrene.

The sleeve 20 has a truncated slightly conical configuration including a circular open lower end 26 and a relatively larger circular open upper end 28 defining an elongate tapered through passage which closely conforms to the outer configuration of the cup wall 14 about the upper portion thereof slightly spaced below the rim 18. In other words, the sleeve 20 is configured to slidably receive the cup 12 downwardly therein with the sleeve snugly engaging the cup within the area normally gripped by the hand and slightly below the rim so as to not impede drinking from the cup. As the cups normally come in different sizes, the protectors will also be provided in different sizes to accommodate the cups. It will also be noted that while the upper end of 28 of the sleeve 20 is preferably spaced below the cup rim 18, the tether 24 is of sufficient length to allow for the proper mounting and opening of the cup lid 22.

In order to provide the desired insulation between the hand and the cup wall 14, the sleeve, for at least a major portion of the height thereof between the open lower and upper ends 26 and 28, is provided with a series of vertical flutes or corrugations 30 completely about the sleeve. These flutes or corrugations 30 are thermoformed within the material of the protector 10 and do not require extra material or thicker material, rather, relying on the spaces provided by the alternating oppositely directed inner ridges 32 and outer ridges 34 to provide the insulation. The inner ridges 32, peripherally spaced from each other, engage the outer surface of the cup wall 14 as does any smooth portions 36 of the sleeve 20 which might project above and/or below the central fluted hand-grip area. The outwardly directed ridges 34, aligned with the insulating spaces immediately inward thereof and between the inner ridges 32, provide the actual gripping surface. This gripping surface, by its very nature, is roughened to enhance the grip of a hand, with further insulating spaces being defined between adjacent outer ridges 34 as the hand will normally span thereacross.

The illustrated flutes are considered the most practical, effective and economical manner of providing for the desired insulation. However, as will be appreciated, other acceptable forms of insulation can be incorporated into the sleeve, for example, an insulating foam collar can be mounted externally about a basic smooth-surface sleeve. Other possible variations are also contemplated within the scope of the invention, including the possibility of extending the insulating flutes for the full height of the sleeve.

The protector, as illustrated, is capable of being provided in nested stacks, much in the manner of known plastic lids, and can be individually dispensed in accord with the requirements of the particular cup involved. Should a particular beverage cup not require the insulating sleeve, one would merely use a conventional lid from an appropriate stack of such lids. Similarly, should it be desirable to remove the lid 22 from the sleeve 20 of the protector 10, as for example immediately prior to a consuming of all of the contents of the cup, the tether 24 is specifically provided with an area of weakness 38 at an appropriate point along the length thereof which will enable a fracture or tearing of the tether 24 along a transverse line with minimal effort and without disrupting the sleeve. As will be appreciated, such a severing of the lid from the sleeve will also allow for a disposal of the sleeve while the lid is retained.

As to the structure of the lid 22 itself, the lid is basically of a conventional configuration, and includes a top panel 40 with a depending peripheral flange 42. The tether 24 preferably joins the lid at the outer edge of the flange 42. While the cup has been illustrated as substantially cylindrical, such being the most common cup configuration, cups of other configurations can also be accommodated by configuring the sleeve and lid portions of the protector thereto.

The foregoing is illustrative of the features of the invention. While a single preferred embodiment of the invention has been illustrated, it is to be appreciated that the scope of the invention is intended to encompass all embodiments falling within the parameters of the claims following hereinafter.

I claim:

1. A cup accessory comprising a vertically elongate sleeve defining a vertical through passage with opposed open upper and lower ends, a cup lid including a top panel with a depending peripheral portion, and a tether extending between and integral with each of said sleeve and said lid for limited manipulation of said lid relative to said sleeve, said tether being flexible between said lid and said sleeve, and an area of weakness in said tether for a selected severance of said tether thereat and a separation of said lid from said sleeve.

2. The cup accessory of claim 1 wherein said sleeve includes a vertically extending hand-grip portion between said open upper and lower ends, said hand-grip portion being defined by a series of flutes formed in said sleeve peripherally thereabout, said flutes forming a series of spaces about said sleeve inwardly directed into said through passage, said hand-grip portion terminating vertically inward of said open upper and lower ends.

3. The cup accessory of claim 1 wherein said accessory is of a vacuum formed synthetic resinous material.

4. A protector for protectively encircling and closing a drinking cup, the cup having a cup wall defining an upwardly opening cup mouth; said protector comprising a sleeve defining a through passage with vertically spaced opposed open upper and lower ends adapted to receive a cup therein and therethrough, a cup lid for engagement with the cup mouth of a sleeve-received cup, and a tether joined to and extending between said sleeve and said lid for limited manipulation of said lid relative to said sleeve, said tether being flexible between said lid and said sleeve, and an area of weakness in said tether for a selected severance of said tether thereat and a separation of said lid from said sleeve.

5. A protector for protectively encircling and closing a drinking cup, the cup having a cup wall defining an upwardly opening cup mouth; said protector comprising a sleeve defining a through passage with vertically spaced opposed open upper and lower ends adapted to receive a cup therein and therethrough, a cup lid for engagement with the cup mouth of a sleeve-received cup, and a tether joined to and extending between said sleeve and said lid for limited manipulation of said lid relative to said sleeve, said sleeve including a hand-grip portion between said upper and lower ends, said sleeve further including an inner surface for engagement with the wall of a sleeve-received cup, and means for insulating said hand-grip portion comprising spaces defined by said hand-grip portion and opening inwardly toward said through passage and the cup wall of a sleeve-received cup, said hand-grip portion including vertically extending flutes peripherally about said hand grip portion, said flutes defining, alternatively, inwardly directed ridges for engagement with a cup wall and outwardly directed ridges for engagement by a gripping hand, said hand-grip portion terminating vertically inward of said open upper and lower ends.

6. The protector of claim 5 wherein said tether is flexible between said lid and said sleeve, and an area of weakness in said tether for a selected severance of said tether thereat and a separation of said lid from said sleeve.

7. The protector of claim 6 wherein said sleeve tapers from a minimum diameter at said open lower end to a maximum diameter at said open upper end.

* * * * *